United States Patent [19]

Rambold

[11] 4,110,955

[45] Sep. 5, 1978

[54] INFUSION BAG AND METHOD OF PACKAGING INFUSION BAG

[76] Inventor: Adolf Rambold, Bachstrasse 8, Meerbusch 1, Fed. Rep. of Germany, 4005

[21] Appl. No.: 701,601

[22] Filed: Jul. 1, 1976

[30] Foreign Application Priority Data

Jul. 2, 1975 [DE] Fed. Rep. of Germany ..... 2529429

[51] Int. Cl.[2] ..... B65B 5/06; B65B 5/08; B65B 7/26; B65B 35/56

[52] U.S. Cl. ..... 53/445; 53/416; 53/469

[58] Field of Search ..... 426/77, 78, 79, 80, 426/81, 82, 83, 84, 108, 110, 115, 394; 206/0.5, 804; 53/35, 37, 14, 26

[56] References Cited

U.S. PATENT DOCUMENTS

| | | | |
|---|---|---|---|
| 2,192,605 | 3/1940 | Salfisberg | 53/14 X |
| 2,359,292 | 10/1944 | Barnett | 206/0.5 X |
| 2,577,765 | 12/1951 | Irmscher | 53/14 X |
| 2,891,867 | 6/1959 | Irmscher | 426/83 |
| 2,893,550 | 7/1959 | Sandmeyer | 53/26 X |
| 3,215,533 | 11/1965 | Rambold | 426/82 |
| 3,387,978 | 6/1968 | Major | 426/80 |
| 3,899,599 | 8/1975 | Rambold | 426/82 |

*Primary Examiner*—Horace M. Culver
*Attorney, Agent, or Firm*—Wigman & Cohen

[57] ABSTRACT

An improved infusion bag for containing, for example, tea, is disclosed wherein the top of the bag is reinforced by a flexible strip folded into two wings which encompass the top of the bag. One wing extends along the length of the bag and projects beyond the bottom to serve as a pull strap for removing the bag from a box-like container. A method of packaging a plurality of such infusion bags is also disclosed.

3 Claims, 2 Drawing Figures

INFUSION BAG AND METHOD OF PACKAGING INFUSION BAG

BACKGROUND OF THE INVENTION

This invention relates to an infusion bag having at least one chamber for holding, for instance, tea, and more particularly to a double-chambered bag, the top of which is reinforced by a flexible strip that forms two pleated wings encompassing the top of the bag. The wings are attached to the bag, at least one wing covering the entire length of the bag and projecting beyond the bottom of the bag. The invention also relates to a method for packaging such bags, in which several bags are inserted in the same position in a rectangular box that opens on the top.

U.S. Pat. No. 2,192,605 describes an infusion bag of the type mentioned, in which the two wings of the strip made of flexible elastic material, such as aluminum foil, cover the actual bag on both sides and project an equal distance beyond its bottom. The purpose of the two projecting wings is to protect the base of the bag itself and to make the strip sufficient in length for handling the bag when the two wings are folded back and lying against each other.

Infusion bags of the above type are generally packaged in the manner described above. Thereby, the tops of the individual bags are so closely packed that it is difficult to grasp the tops of the bags and pull them out of the box, despite the fact that the material to be extracted from the bag collects at the base, especially in the case of double-chambered bags, whereupon there is a somewhat greater distance between the tops. But even this collection in the base of the bag, which causes a compression of the material during transport of the boxes, is disadvantageous, because the accumulation and compression of the material in the base of the bag leads to a reduction in the material surface, and the material is consequently extracted with greater difficulty upon infusion.

U.S. Pat. No. 2,614,934 describes an infusion bag in which the lower half of the chamber, which contains all the material to be extracted, is turned upward and laid against the upper, empty chamber half, whereupon the top and base of adjacent bags become positioned next to one another. Attached to the top of the bag is the middle segment of a V-shaped upright crosspiece that connects two strip pieces covering the bag on either side, which pieces are also connected along their three other edges, so that the folded bag is inside an open-topped pouch or sack that can be packaged in any position. When the infusion bag is used, however, the material will always remain in the lower chamber half, whereupon the extraction of the material is possible only in an incomplete manner.

U.S. Pat. No. 2,359,292 (FIGS. 1 and 2) describes an infusion bag having a strip attached in the middle of the bag top which covers the entire length of the bag before its use and would project beyond the bottom of the bag (FIG. 4), if the projecting length were not inclined along a fold line in the covering segment of the strip and folded around the bottom of the bag and upward, so that when several such infusion bags are packaged, the projecting length disappears between two adjacent bag bottoms. However, the projecting length is a positioning strap and not a pull strap, for it serves only to fix the strip in upright position during normal packaging of the bag, and is neither intended nor suited for serving as a handle in pulling the bag from its package, for the positioning strap is located at the bottom of the bag, where it cannot be grasped, as only the tops of the bags are revealed when the package is opened.

SUMMARY AND OBJECTS OF THE INVENTION

It is an object of the invention to eliminate the aforementioned disadvantages and to improve the ease of handling and the extractability of infusion bags of the type in question.

This problem is solved on one hand by the fact that the projection of the covering strip wings is designated as a pull strap for pulling the bag from its package, and, on the other hand, by the fact that upon packaging, the bags are inserted into the box top-down and bottom-up, so that the projections of the covering strip wings can be grasped as pull straps. In this way, the individual bags can be easily and securely grasped in the box, and the substance to be extracted first collects in the narrower top (especially true in the case of double-chambered bags), whereby it is distributed over a greater area of the bag than in the case of accumulation at the base. Then, when the bag is pulled out of the box and turned around to the position in which it will be used, part of the material collected in the top drops to the base, so that the material almost completely fills the bag chamber. Only in this manner can there be insured an effective extraction of the material being used for the infusion.

In case of a preferred embodiment of the infusion bag according to the present invention, only one of the two strip wings covers the entire length of the bag, and the pull strap hangs along a fold line in the covering section of this projecting wing. The fold line makes it possible to bend the single pull strap of the bag in such a way that it projects in inclined position above the base of the bag, whereby any sliding back and forth of the bag in the box is avoided. The prefolding can best be achieved by using plastic-coated paper as the most advantageous material for the strip.

BRIEF DESCRIPTION OF THE DRAWINGS

In the following, the invention is described in reference to the drawings and a preferred embodiment of the bag according to the invention illustrated in the same, wherein.

DETAILED DESCRIPTION OF A PREFERRED EMBODIMENT

Figure 1:
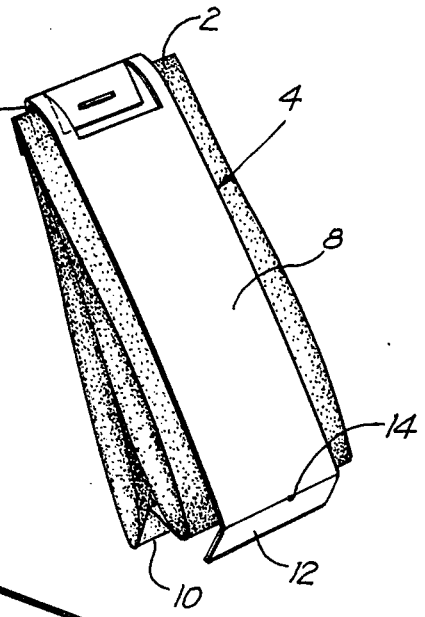
FIG. 1 shows a perspective view of an embodiment of the invention.

Referring to FIG. 1, the embodiment is a double-chambered bag, the top 2 of which is reinforced by a flexible strip 4 that forms two folded wings 6 and 8 that encompass the top of the bag and are attached to it. At least one of these, the wing 6, covers only the top 2, while the wing 8 covers the entire length of the bag and projects beyond its bottom 10. The projecting length is designed to serve as a pull strap 12 for pulling the bag from a package. The pull strap 12 hangs along a fold line 14 on the covering section of the projecting strip wing 8.

Figure 2:
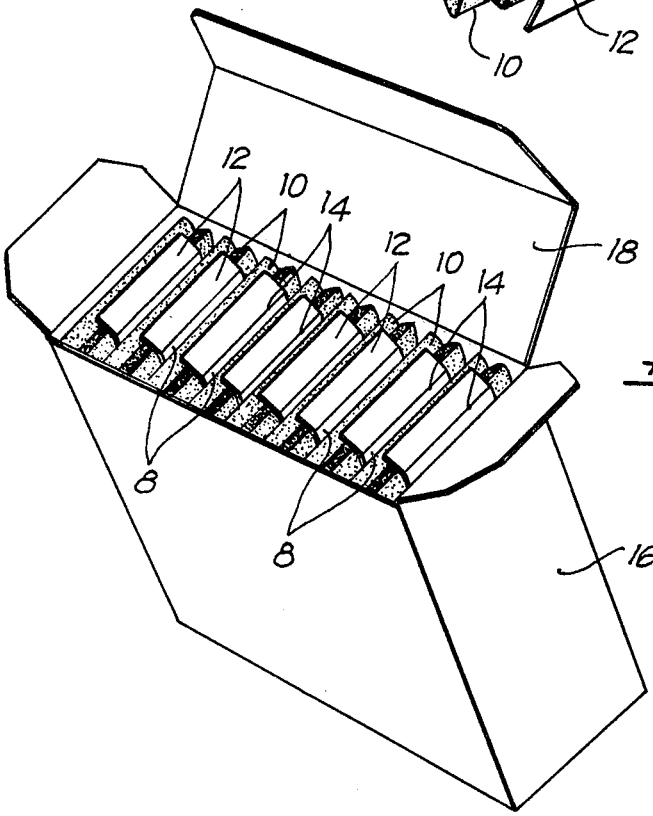
FIG. 2 shows a perspective view of several embodiments packaged in a box that opens on the top.

As shown in FIG. 2, several embodiments of the described double-chamber bag are inserted in the same position, with the top 2 facing down and the bottom 10 facing up, into an open-topped, rectangular box 16, so that the pull straps 12 can be grasped on the top. The pull straps 12 are bent along their fold lines 14, all in the same direction, over the bottom 10 of the bag, so that when closed, the box lid 18, is tight over the bottoms of the bags and the pull straps 12 lie against it.

Other examples of advantageous and practical designs of the strip 4 are found in German Patent Specification No. 2,264,566. The invention can be used preferentially on the infusion bags described therein.

Although only a preferred embodiment is specifically illustrated and described herein, it will be appreciated that many modifications and variations of the present invention are possible in the light of the above teachings and within the purview of the appended claims without departing from the spirit and intended scope of the invention.

What is claimed is:

1. A method of packaging beverage infusion bags for tea and the like in horizontal, side-by-side relation comprising the steps of:

providing a plurality of infusion bags containing an infusion material, each bag having a top and a bottom, said top being reinforced by a flexible strip folded to form two wings attached to and encompassing the top of the bag, at least one of said wings extending the entire length of the bag from top to bottom and having a portion projecting beyond the bottom of the bag, the projecting portion having a free end;

providing a container for said infusion bags, said container having an opening on one side thereof and a container bottom on the side of said container opposite said opening;

allowing the infusion material to distribute toward the tops of the infusion bags by directing the tops of the bags downwardly; and inserting said infusion bags into said container with the tops thereof confronting the bottom of said container, the bottoms of said infusion bags being adjacent said opening, and the free ends of the projecting portions being exposed and lying adjacent the bottoms of the infusion bags and the opening whereby the projecting portion of said one wing of each said infusion bags constitutes a pull strap adapted to be grasped to pull the infusion bag from said container such that said infusion bag inverts to a use position and the infusion material distributes over a greater area of the bag.

2. The method according to claim 1, wherein each projecting portion of the one wing is folded over the bottom of its respective infusion bag, said inserting step including the step of directing the folded projecting portions of all said bags in the same direction such that said projecting portions lie within said container.

3. The method according to claim 2, wherein said container has a closable lid for said opening and including the step of closing said lid such that the free ends of the folded projecting portions lie adjacent said lid.

* * * * *